US010690432B2

(12) United States Patent
Campbell et al.

(10) Patent No.: US 10,690,432 B2
(45) Date of Patent: Jun. 23, 2020

(54) SOUND SUPPRESSING GUN BARREL

(71) Applicants: Kevin C. Campbell, Maize, KS (US); Jeff A. White, Maize, KS (US)

(72) Inventors: Kevin C. Campbell, Maize, KS (US); Jeff A. White, Maize, KS (US)

( * ) Notice: Subject to any disclaimer, the term of this patent is extended or adjusted under 35 U.S.C. 154(b) by 0 days.

(21) Appl. No.: 16/245,545

(22) Filed: Jan. 11, 2019

(65) Prior Publication Data

US 2020/0025493 A1 Jan. 23, 2020

(51) Int. Cl.
*F41A 21/30* (2006.01)
*F41A 21/24* (2006.01)

(52) U.S. Cl.
CPC ..... *F41A 21/30* (2013.01); *F41A 21/24* (2013.01)

(58) Field of Classification Search
CPC ..... F41A 21/24; F41A 21/28; F41A 21/30
USPC ..... 89/14.4; 181/223
See application file for complete search history.

(56) References Cited

U.S. PATENT DOCUMENTS

| | | | | | |
|---|---|---|---|---|---|
| 1,021,742 | A | | 3/1912 | Moore | |
| 1,363,058 | A | * | 12/1920 | Schneider | F41A 21/36 89/14.3 |
| 2,514,996 | A | | 7/1950 | Faust, Jr. | |
| 3,399,597 | A | | 9/1968 | Perrine | |
| 4,176,487 | A | * | 12/1979 | Manis | F41A 21/00 102/470 |
| 4,291,610 | A | | 9/1981 | Waiser | |
| 4,576,083 | A | | 3/1986 | Seberger, Jr. | |
| 5,029,512 | A | | 7/1991 | Latka | |
| 5,097,614 | A | * | 3/1992 | Strong | F41A 21/28 42/76.01 |
| 5,136,923 | A | * | 8/1992 | Walsh, Jr. | F41A 21/30 89/14.2 |
| 5,355,765 | A | * | 10/1994 | Rogers | F41A 13/12 89/14.4 |
| 7,073,426 | B1 | | 7/2006 | White | |
| 7,207,258 | B1 | | 4/2007 | Scanlon | |
| 7,237,467 | B1 | | 7/2007 | Melton | |
| 7,308,967 | B1 | | 12/2007 | Hoel | |
| 7,353,741 | B2 | * | 4/2008 | Brixius | F41A 13/06 42/90 |

(Continued)

FOREIGN PATENT DOCUMENTS

| | | |
|---|---|---|
| EP | 2325594 | 5/2011 |
| WO | WO2016126227 | 8/2016 |

*Primary Examiner* — Bret Hayes
(74) *Attorney, Agent, or Firm* — Kenneth H. Jack; Davis & Jack, L.L.C.

(57) ABSTRACT

A sound suppressing gun barrel incorporating a bullet channel having breachward and muzzleward ends; at least a first "U" channel positioned radially outwardly from the bullet channel, the at least first "U" channel having a web, having a gas receiving arm extending muzzlewardly from the web, and having first and second gas conveying arms extending muzzlewardly from opposite ends of the web; the sound suppressing gun barrel further having an inlet port opening the at least first "U" channel at a muzzleward end of the at least first "U" channel's first gas conveying arm, the inlet port communicating with the bullet channel; the sound suppressing gun barrel further having an outlet port further opening the at least first "U" channel, the outlet port being positioned at a muzzleward end of the at least first "U" channel's second gas conveying arm.

19 Claims, 7 Drawing Sheets

(56) References Cited

U.S. PATENT DOCUMENTS

| | | | | |
|---|---|---|---|---|
| 7,412,917 | B2 | 8/2008 | Vais | |
| 8,100,224 | B1 | 1/2012 | Olson | |
| 8,505,431 | B2 | 8/2013 | Hines | |
| 8,579,075 | B2 | 11/2013 | Brittingham et al. | |
| 8,910,746 | B1 | 12/2014 | McKenzie | |
| 8,967,326 | B2 | 3/2015 | Schlosser | |
| 8,978,818 | B2 | 3/2015 | Proske | |
| 9,086,248 | B2 | 7/2015 | Young et al. | |
| 9,115,949 | B1 | 8/2015 | Morrison | |
| 9,182,188 | B2 | 11/2015 | Gawencki | |
| 9,194,640 | B2 | 11/2015 | Wirth et al. | |
| 9,207,033 | B2 | 12/2015 | Vais | |
| 9,417,021 | B2 | 8/2016 | Pietila | |
| 9,593,899 | B2 | 3/2017 | Coppinger et al. | |
| 9,874,418 | B2 | 1/2018 | White et al. | |
| 10,077,962 | B1 * | 9/2018 | Dean | F41A 21/30 |
| 2012/0291614 | A1 * | 11/2012 | Koumbis | F41A 21/30 89/14.4 |
| 2015/0101882 | A1 * | 4/2015 | Moss | F41A 21/30 181/223 |
| 2016/0054086 | A1 | 2/2016 | Westlake | |
| 2016/0123689 | A1 * | 5/2016 | Maeda | F41A 21/30 89/14.3 |
| 2019/0145727 | A1 * | 5/2019 | Campbell | F41A 21/30 89/14.4 |
| 2019/0257607 | A1 * | 8/2019 | Dobrinescu | F41A 21/30 |
| 2019/0285375 | A1 * | 9/2019 | Hartwell | F41A 21/30 |

* cited by examiner

SOUND SUPPRESSING GUN BARREL

FIELD OF THE INVENTION

This invention relates to rifle and gun barrels. More particularly, this invention relates to special adaptations of and configurations of rifle and gun barrels for sound suppression.

BACKGROUND OF THE INVENTION

Commonly configured gun and rifle silencers include series of baffles, vanes, and walls arrayed about the path of a fired bullet at or near the muzzle of the firearm. Such baffles, vanes, and walls commonly form sound reflection chambers which open radially inwardly at the weapon's bullet conveying bore or channel. Portions of a sonic blast generated upon firing the weapon enter such chambers and are reflected, producing sound suppression. Such silencer chambers commonly exclusively reflect portions of the sonic blast radially inwardly toward the axial bullet passageway. Such exclusive radially inward reflection of the sonic blast undesirably diminishes the ability of the suppressor to reduce the intensity of the portion of the sonic blast which emits from the weapon's muzzle.

The instant inventive sound suppressing gun barrel solves or ameliorates problems and deficits noted above by specially configuring the barrel of a gun barrel or rifle barrel to include specialized sonic blast diverting "U" channel structures.

BRIEF SUMMARY OF THE INVENTION

The instant inventive sound suppressing gun barrel may comprise modifications, as specified below, of a conventional gun barrel or may comprises a specialized cylindrical screw-on barrel extension or silencer attachment. In accordance with the instant invention, such alternative screw-on and removable silencer or barrel extension is considered to constitute a gun barrel or a muzzleward segment of a gun barrel.

A first structural component of the instant inventive sound suppressing gun barrel comprises a bullet channel having a breachward end and having a muzzleward end. The breachward end of the bullet channel may be configured in the manner of a conventional rifled bullet accelerating bore. In the preferred embodiment, the muzzleward end of the bullet channel incorporates specialized sound suppressing structures described below.

A further structural component of the instant inventive sound suppressing gun barrel comprises at least a first "U" channel which is rigidly and structurally positioned radially outwardly from the bullet channel. In the preferred embodiment, the at least first "U" channel has a breachwardly positioned web, such web having and communicating with a pair of gas conveying arms. One of such gas conveying arms preferably comprises a gas receiving arm or first gas conveying arm which extends muzzlewardly from a circumferential end of the web, and the other arm of such pair of gas conveying arms comprises a gas emitting or second arm. Such second arm preferably co-extends muzzlewardly along the first arm from the oppositely circumferential end of the web. Preferably, the breachward wall of such web faces muzzlewardly and is arcuately and concavely curved.

A further structural component of the instant inventive sound suppressing gun barrel comprises a gas intake port which opens the at least first "U" channel at the muzzleward end of such channel's gas receiving arm or first gas conveying arm. In the preferred embodiment, the intake port further opens at and communicates with the muzzleward end of the bullet channel for conveying portions of sonic blast gases from the muzzleward end of the bullet channel into the first arm of the at least first "U" channel.

In operation of the instant inventive sound suppressing gun barrel, explosively compressed gases traveling muzzlewardly along the bore of a rifle barrel and immediately behind a fired bullet may radially outwardly expand to enter the at least first "U" channel's intake port. Instead of reflecting radially inwardly, such gases advantageously travel breachwardly along the at least first "U" channel's gas receiving arm until such gases reach such arm's breachward end. The web component at the arm's breachward end turns such compressed gases oppositely circumferentially and substantially 180° to travel muzzlewardly along the at least first "U" channel's second gas conveying arm. Such breachward and muzzleward passages of the compressed gas along the paired arms of the at least first "U" channel efficiently suppresses and reduces the magnitude of the sonic blast which emits from the weapon's muzzle.

In a preferred embodiment, the instant inventive sound suppressing gun barrel further comprises a gas output port which further opens the at least first "U" channel at a muzzleward end of such "U" channel's second gas conveying arm. Such output port suitably opens radially outwardly at a ceiling component which covers both "U" channel arms. Suitably, such output port may alternatively open radially inwardly toward the bullet channel.

Further preferred structural components of the instant inventive sound suppressing gun barrel comprise a plurality of second "U" channels, each second "U" channel preferably being configured substantially identically with the at least first "U" channel. In a preferred embodiment, the at least first "U" channel and such plurality of second "U" channels are evenly circumferentially arrayed about the bullet channel.

The invention's "U" channel components may be provided in combination with conventional wall and baffle formed sound suppressing chambers. For enhanced length and consistency with bullet spin, the "U" channels' arms may extend helically about the bullet channel.

Accordingly, objects of the instant invention includes the provision of a sound suppressing gun barrel which incorporates structures, as described above, and arranges those structures with respect to each other in manners described above, for the achievement of the beneficial functions described above.

Other and further objects, benefits, and advantages of the instant invention will become known to those skilled in the art upon review of the Detailed Description which follows, and upon review of the appended drawings.

DETAILED DESCRIPTION OF PREFERRED EMBODIMENTS

Figures 1, 1A:
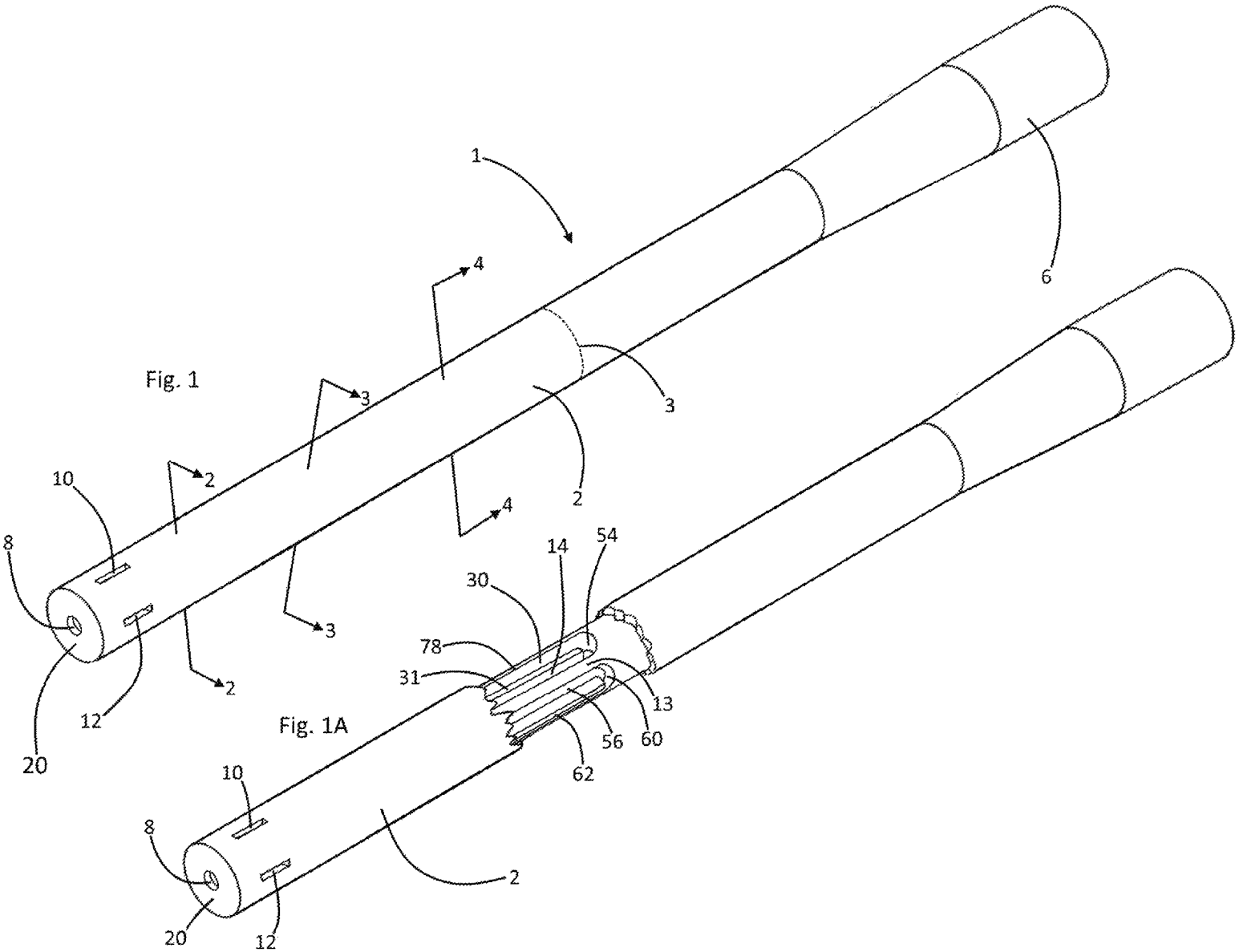
FIG. 1 is a perspective view of a suitable embodiment of the instant inventive sound suppressing gun barrel.
FIG. 1A redepicts the structure of FIG. 1, the view of FIG. 1A showing a portion of a barrel ceiling structure broken away to expose underlying structure.

Referring now to the drawings, and in particular to Drawing FIG. 1, a suitable embodiment of the instant inventive sound suppressing gun barrel is referred to generally by Reference Arrow 1. The gun barrel 1 has a breachward end 6 and a muzzleward end wall 20. Dashed line 3 drawn upon FIG. 1 is representative of an alternative screw on/screw off joint which may be utilized for releasably joining a muzzleward segment of the gun barrel 1 from a breachward segment including breachward end 6. In a preferred embodiment, such muzzleward segment including wall 20 is formed wholly with and integrally with the remainder of the gun barrel.

Figure 2:
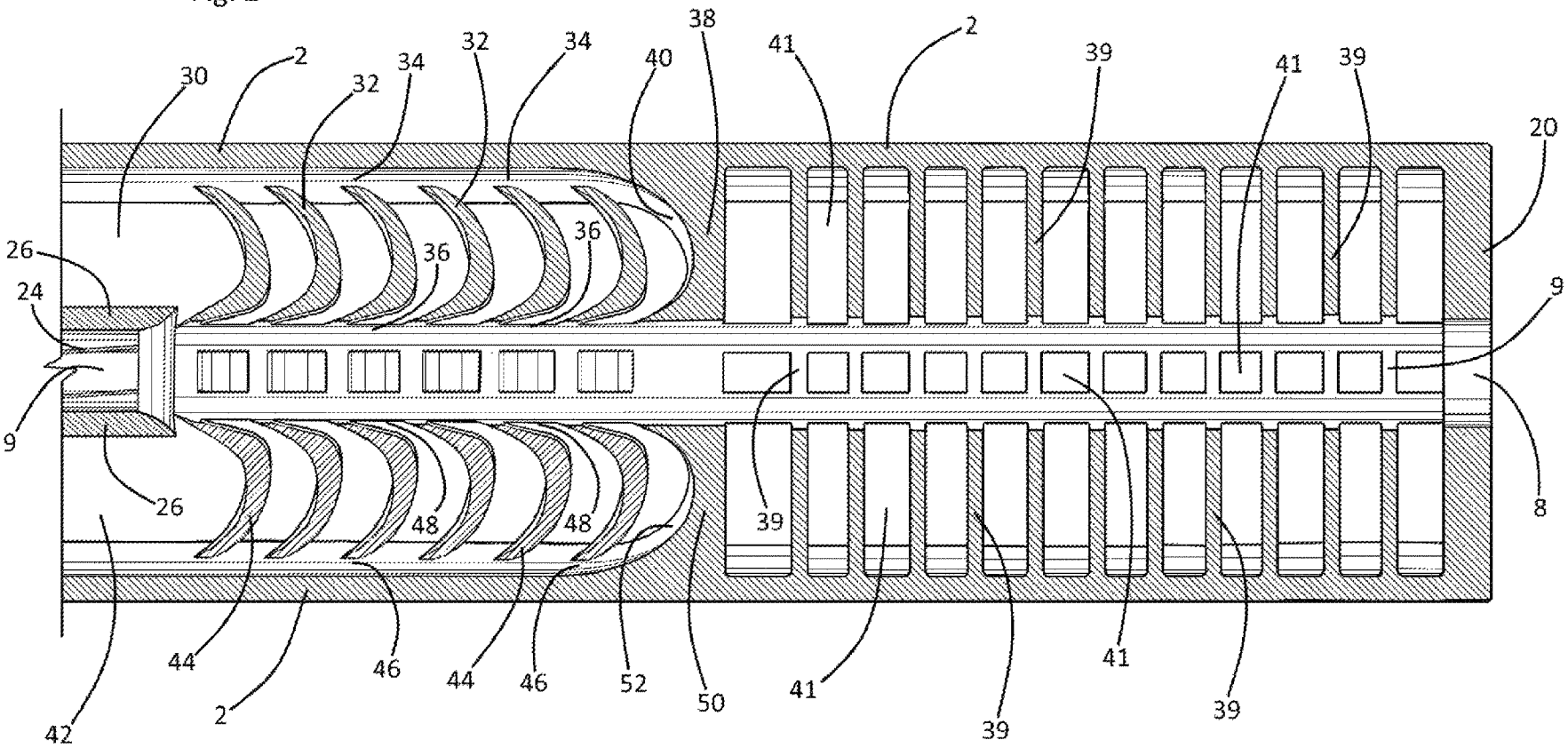
FIG. 2 is a partial sectional view of the sound suppressing barrel of FIG. 1 as indicated in FIG. 1.

Referring simultaneously to FIGS. 1 and 2, a bullet passage channel 9 extends from the breachward end 6 of the gun barrel 1 to its muzzleward end wall 20, such channel 9 having a muzzle opening 8. The breachward end of the bullet passage channel 9 preferably is configured as a conventional gun or rifle barrel 26, the annular inner wall of such barrel 26 preferably having helical rifling 24. A circumferentially extending ceiling 2 (or 102 in the FIG. 5 variant) surrounds the bullet passage channel 9, such ceiling 2 providing and forming a housing structure which contains and supports the specially configured gas channeling and sound blast suppressing structures which are described in detail below.

Descriptions of the gun barrel below include references to a longitudinal direction or axis, and such direction or axis extends along the bullet passage channel 9 in the direction of a bullet's passage therethrough. Descriptions of the structures positioned along the longitudinal axis positioned at or toward the breach end of the gun barrel are described below as being "breachward", and structures residing at or toward the barrel's opposite muzzle end are described as being "muzzleward".

Descriptions of the gun barrel below also refer to a radial direction which extends perpendicularly from the barrel's central longitudinal axis. Structures positioned away from such axis are described as being "radially outer", and structures closer to such axis are described as being "radially inner".

Figure 4:
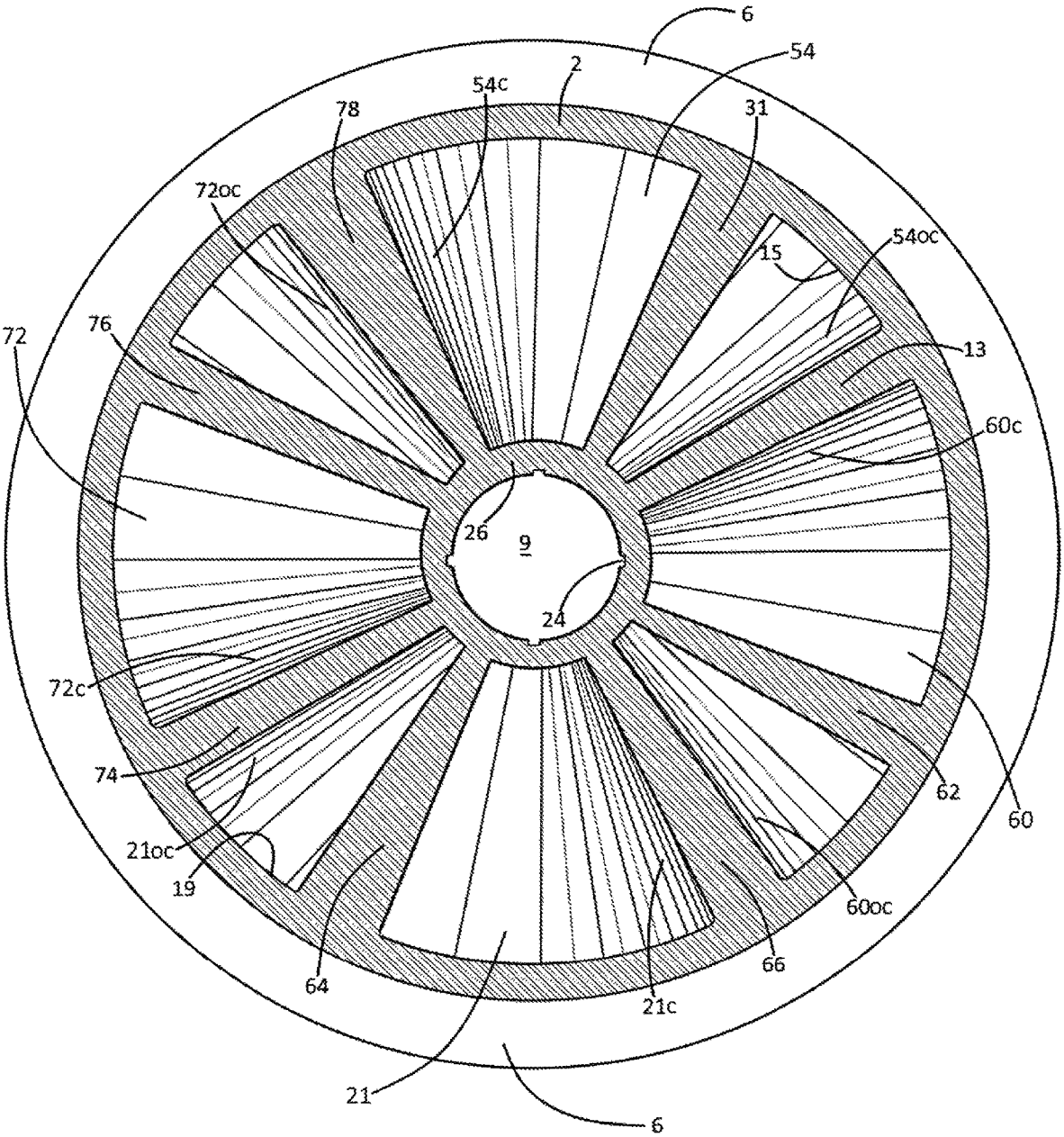
FIG. 4 is a further alternative sectional view as indicated in FIG. 1.

Referring simultaneously to FIGS. 1 and 4, the circumferential direction may be (for the sake of example) understood to be counterclockwise (from the perspective of FIG. 4) about the longitudinal axis of the bullet passage 9, and the oppositely circumferential direction is clockwise. Structures met or viewed upon counterclockwise or circumferential motion are described as "circumferential" structures and structures met or viewed upon clockwise motion are described as "oppositely circumferential" structures.

Referring simultaneously to FIGS. 1-4, at least a first "U" channel is supported at a radially outward position from the bullet channel 9, such channel radially inwardly underlying the ceiling 2. The invention's at least first "U" channel is best viewed in FIG. 1A which exposes (for purposes of explanation) such channel's breachward end. In the view of FIG. 1A, the at least first "U" channel is shown to have a structure which is consistent with the form of a common capital letter U. The invention's at least first "U" channel preferably comprises a breachwardly positioned web portion 54, said web "U" channel portion being breachwardly bounded by an arcuately curved wall having a circumferential end 54*c* and having an end oppositely circumferential end 54*oc*. The muzzlewardly facing breachward wall of such web "U" channel portion 54 preferably concavely curves between said ends.

A first gas conveying arm portion 30 of the first "U" channel communicates with and extends muzzlewardly from the circumferential end of said channel's web portion 54, and a second gas conveying arm portion 14 of said "U" channel similarly communicates with and extends from the oppositely circumferential end of said channel's web portion 54. The preferred arcuately curved and muzzlewardly facing breachward wall of said web portion 54 provides for a smooth oppositely circumferential flow of gases from "U" channel arm portion 30 into "U" channel arm portion 14. The two "U" channel arm portions 30 and 14 in combination with the "U" channel web portion 54 form the at least first "U" channel 30, 54, 14.

Referring in particular to FIG. 2, a gas inlet port 36 opens the at least first "U" channel 30, 54, 14, at the muzzleward end of such channel's first gas conveying "U" channel arm portion 30. In order to prevent explosively driven gasses within the bullet channel 9 from establishing muzzlewardly directed venturi effect at port 36, a series of arcuately curved vanes 32 is preferably formed at such port. A muzzleward wall 38 of the first gas conveying "U" channel's first arm portion 30 preferably functions as a final gas deflecting vane, such wall having a concave breachwardly facing surface 40 for reversing the flow of the muzzlewardly traveling gases. Gas passing through port openings 36 traverses arcuately across the breachward faces of the vanes 32 to enter radially outer gaps 34 and to pass breachwardly into the first "U" channel's arm portion 30.

Gas exiting bore 9 at ports 36 then travels breachwardly along the "U" channel arm portion 30 and reaches the circumferential end 54*c* of said "U" channel's web portion 54. The concave and muzzlewardly facing breachward wall of said web portion 54 then turns such gas in the oppositely circumferential direction about bullet channel 9 and toward the oppositely circumferential end 54*oc* of said "U" channel web portion 54. Upon reaching such oppositely circumferential "U" channel web portion end 54*oc*, such gas progresses muzzlewardly along the arm portion 14 of the at least first "U" channel. The radially outer ends of the at least first "U" channel's first and second gas conveying arm portions 30 and 14 are preferably closed by the circumferentially extending ceiling 2, such ceiling having radially inner surfaces such as inner ceiling surface 15 which overlies the second "U" channel arm portion 14. A muzzleward extension of barrel 26 correspondingly forms a floor of said "U" channel arm portion 14.

Upon reaching the extreme muzzleward end of the second gas conveying arm portion 14 of the at least first "U" channel, the explosively driven gas is reflected by end wall 20, and such gas suitably ejects radially outwardly through an outlet port 10. Alternatively, as shown in the helically configured FIG. 5 variant, such gas similarly ejects radially outwardly through a muzzleward outlet such as outlet 110 or outlet 112. Dashed lines drawn upon FIG. 3 indicate a suitable alternative radially inwardly directed outlet port 11. Such alternate port 11 allows the "U" channel diverted gas to emit radially inwardly into the bullet channel 9 subsequent to a bullet's emergence from the muzzle 8.

Figure 3:
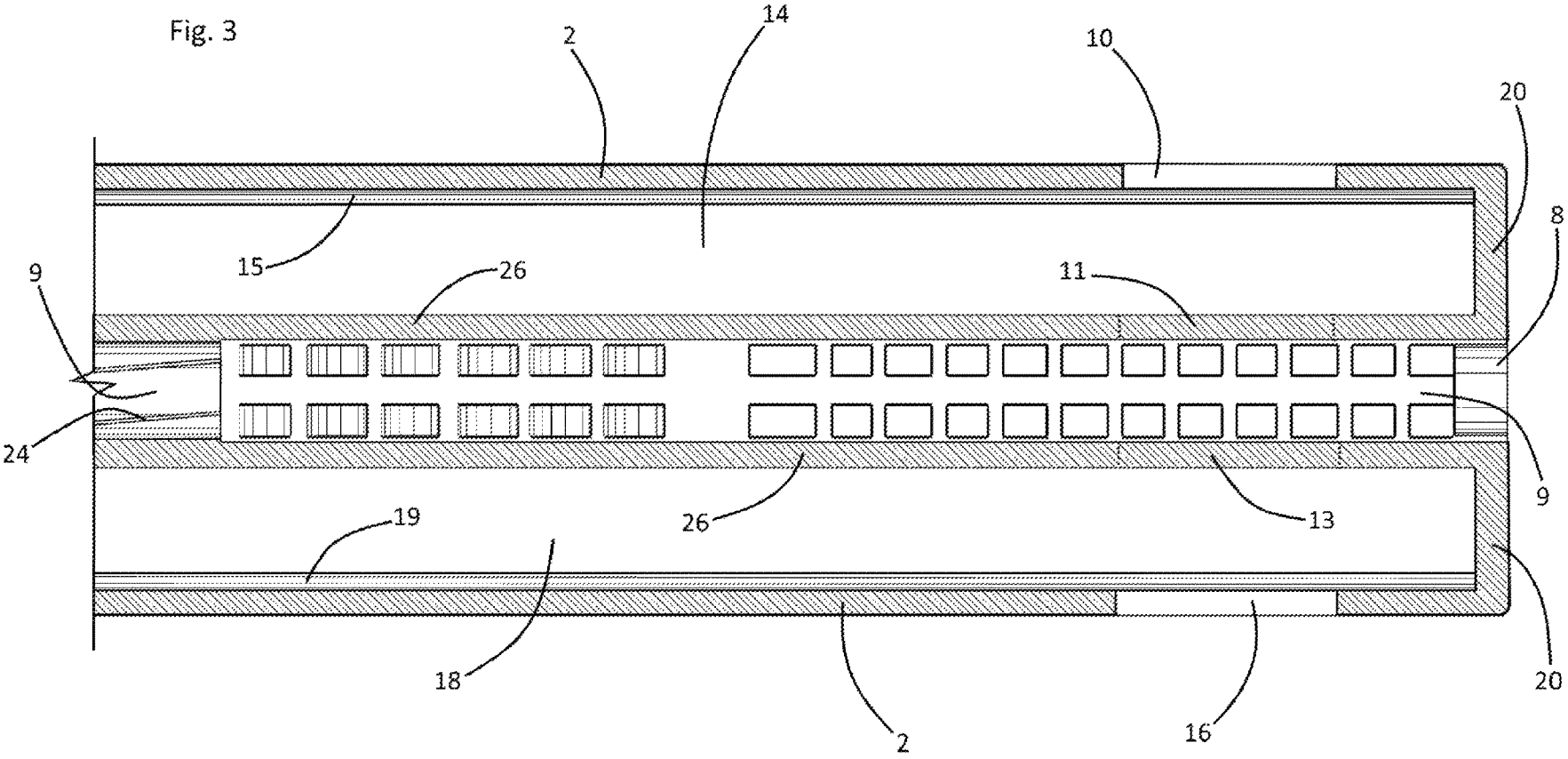
FIG. 3 is an alternative partial sectional view as indicated in FIG. 1.

As indicated by comparison of FIG. 2 with FIG. 3, the extreme muzzleward wall 38 of the at least first gas conveying "U" channel's first arm portion 30 is positioned breachwardly from the extreme muzzleward wall 20 which muzzlewardly terminates said "U" channel's second gas conveying arm portion 14. Such differential in longitudinal positions of the muzzleward ends of the circumferentially adjacent gas conveying "U" channel arm portions 30 and 14 advantageously provides an additional sound suppression space which extends longitudinally from the muzzleward end of the "U" channel arm portion 30. Sound suppressing structures within such longitudinal space suitably include a series of baffles 39 which extend radially inwardly from ceiling 2, such baffles 39 forming a series of radially inwardly opening sound reflection chambers 41. In the FIGS. 5 and 6 structural variant, a corresponding longitudinally extending space may extend helically (matching the helical pitch of the gun barrel's rifling) and may omit any partitioning baffles.

In the FIGS. 1-4 embodiment, the instant inventive sound suppressing gun barrel preferably further comprises a plurality of second "U" channels (e.g., "U" channel 56, 13, 58, as shown in FIG. 1A, and two other substantially identical "U" channels), each channel among such plurality of second "U" channels preferably being configured substantially identically with the at least first "U" channel 30, 54, 14. For example, in the second "U" channel which includes arm portions 42 and 18 (as shown in FIGS. 2 and 3), the muzzleward end of such channel's first gas conveying "U" channel arm portion 42 includes gas outlet port openings 48 which are configured and function similarly with the at least first "U" channel's gas outlet openings 36. A series of arcuately curved vanes 44 is configured similarly with the at least first "U" channel's vane series 32 for conveying gas breachwardly past gaps 46 into a first gas conveying arm 42. A muzzleward end wall 50 of such first "U" channel arm portion 42 of such second "U" channel similarly has a breachwardly facing concave face 52. As with the at least first "U" channel 30, 54, 14, gas diverted breachwardly by vanes 44 and by face 52 travels breachwardly along the gas conveying "U" channel arm portion 42 to successively curve oppositely circumferentially along such "U" channel's web portion from such web portion's circumferential end 21*c* to it's oppositely circumferential end 21*oc*. Such gas then travels muzzlewardly along such "U" channel's second gas conveying arm portion 18 which is similarly bounded radially outwardly by the radially inwardly facing surface 19 of ceiling 2 and by an inner floor comprising barrel 26. Upon reaching the muzzleward end of the second "U" channel's arm portion 18, such gas emits radially outwardly through outlet port 16 or, alternatively, emits radially inwardly through port 13. Two additional second "U" channels (not shown in the views of FIGS. 2 and 3) are preferably configured substantially identically with and function substantially identically with the two "U" channels which are partially shown in FIGS. 2 and 3.

Longitudinally extending walls 31, 13, 62, 66, 64, 74, 76, and 78 span between the radially inner gun barrel forming wall 26 and the radially outer ceiling 2 to partition and form the several arms of the at least first and plurality of second "U" channels. Such walls preferably form and define the "U" channels in an evenly spaced circumferential array, and such walls preferably volumetrically bias each "U" channel so that its gas receiving first arm portion has a larger interior volume than that of it's oppositely circumferentially adjacent second gas conveying arm portion. As indicated in FIG. 4, the circumferential dimensions of the "U" channel's first arm portions are larger than those of their corresponding gas emitting second "U" channel arm portions. Such differentials in circumferential dimensions advantageously compress and accelerate flowing gases as they traverse the "U" channels for additional and enhanced sound suppression.

Figure 5:
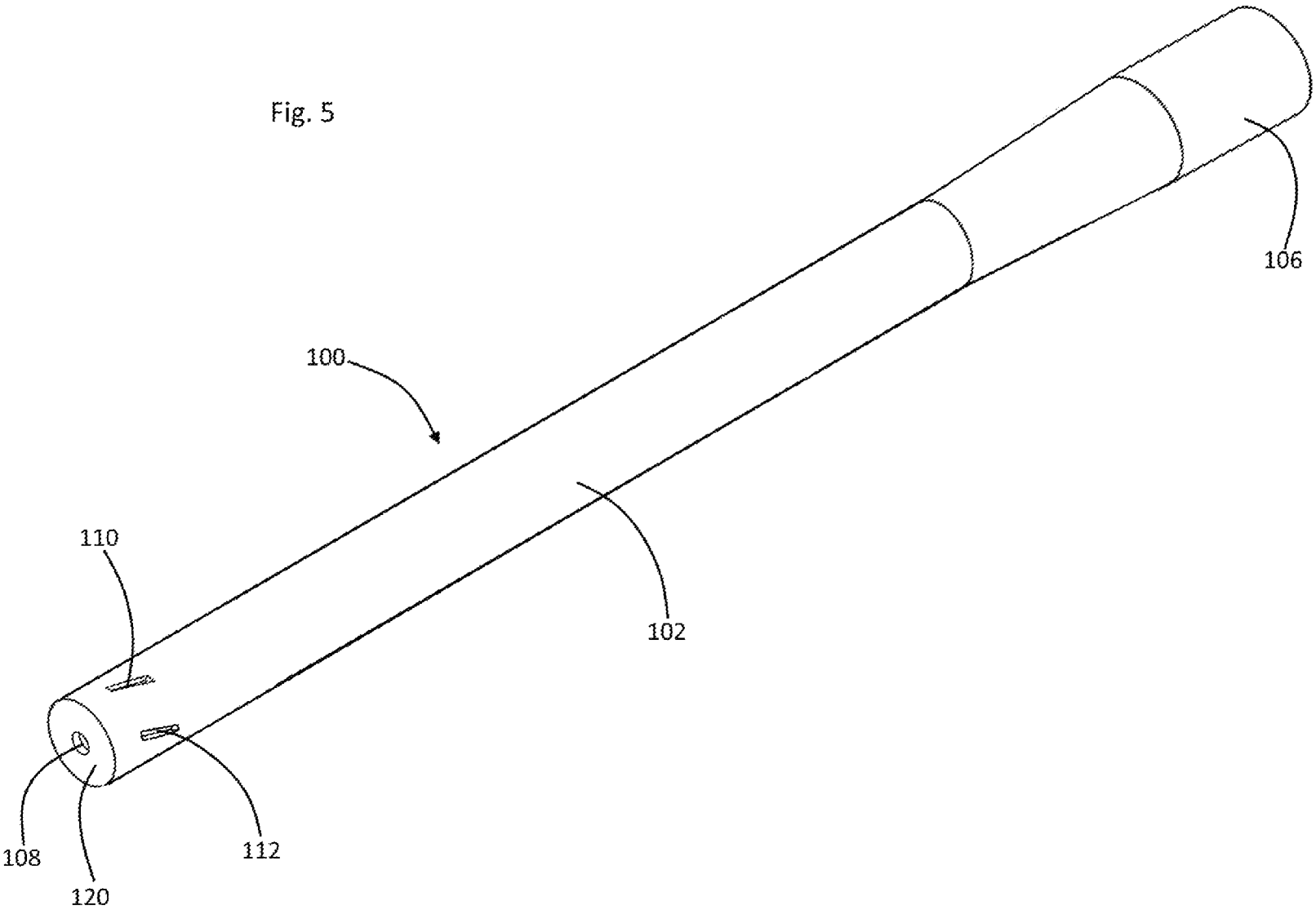
FIG. 5 is a perspective view of an alternate configuration of the sound suppressing gun barrel of FIG. 1.
Figure 6:
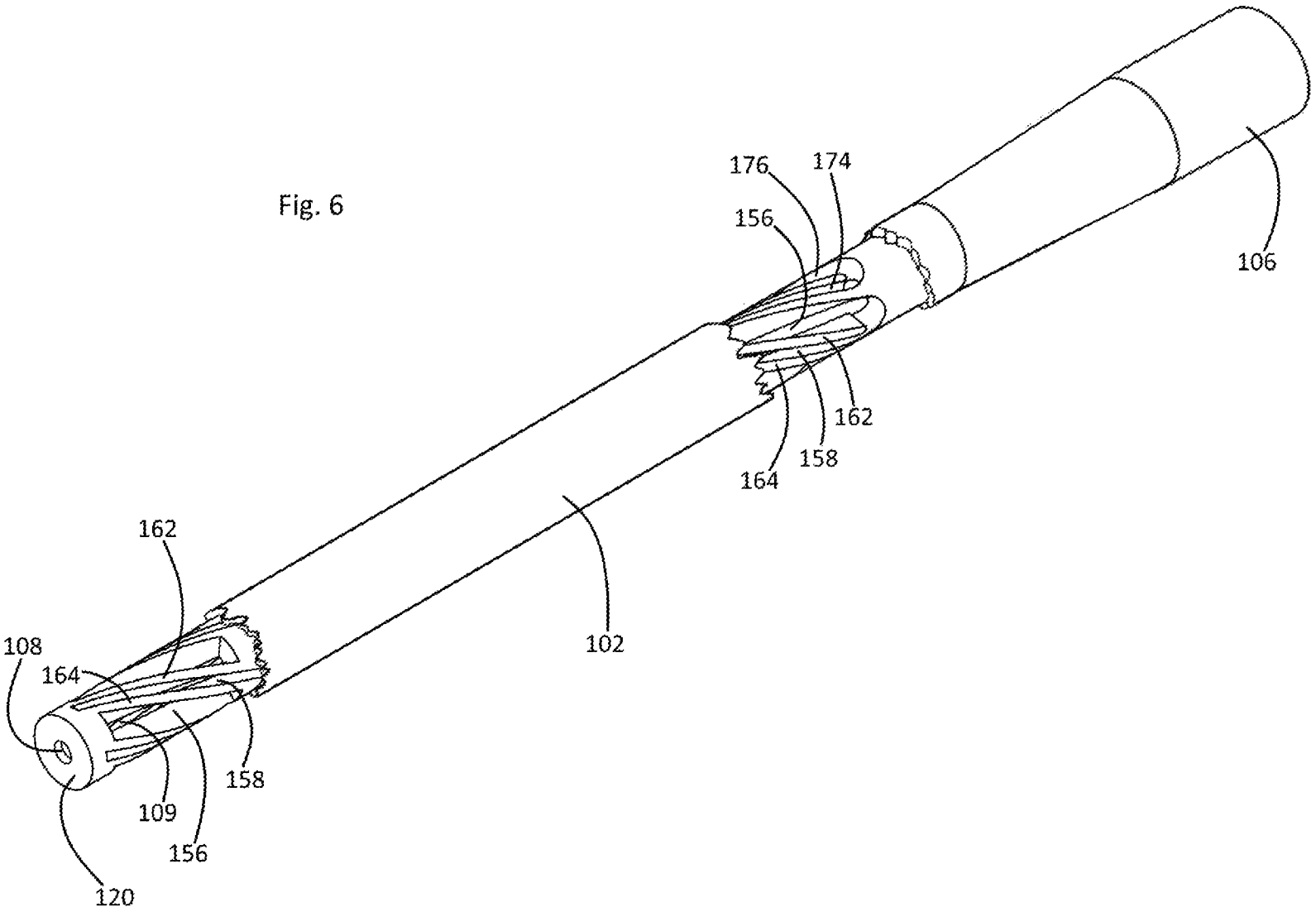
FIG. 6 redepicts the structure of FIG. 5, the view of FIG. 6 including cutaway portions exposing underlying structures to view.
Figure 7:
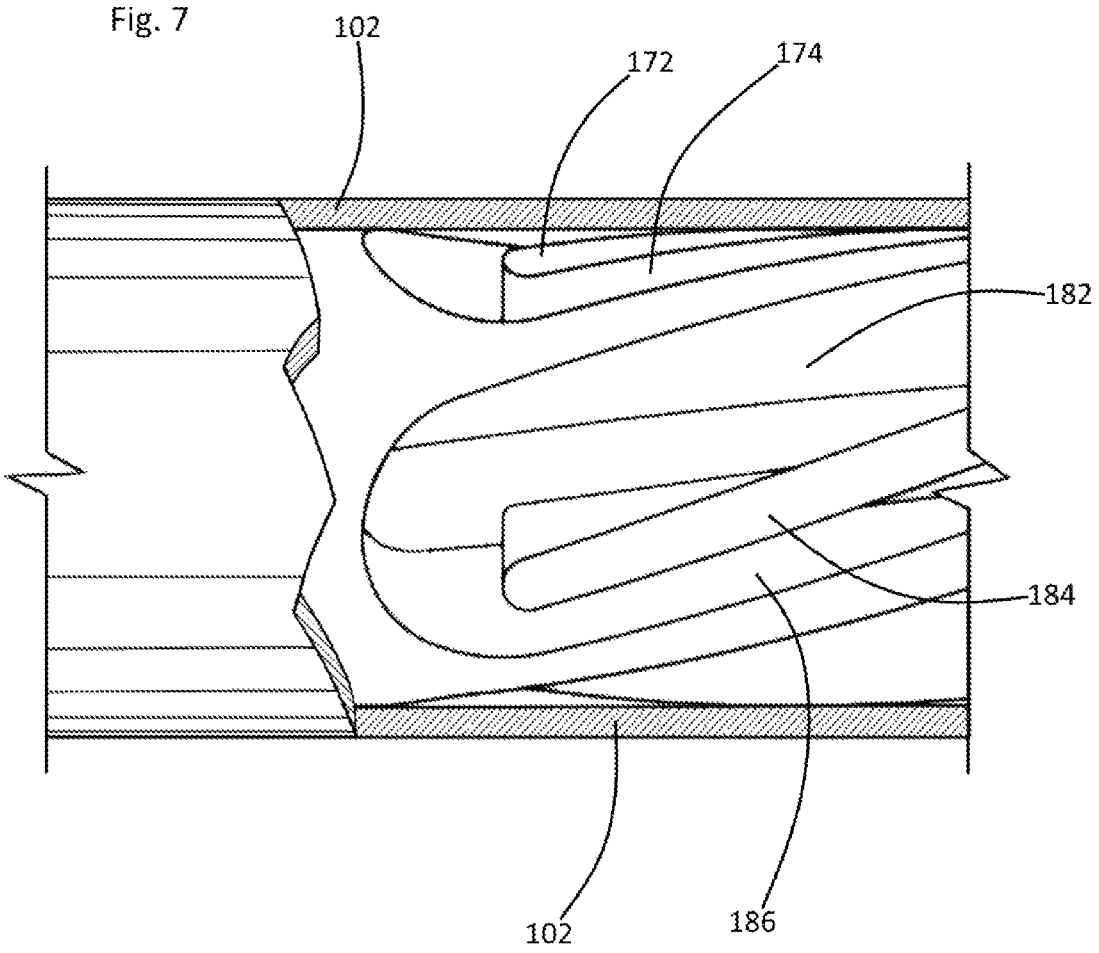
FIG. 7 is an alternate partial cutaway view of structure of FIGS. 5 and 6.

Referring to the alternative configuration of FIGS. 5-7, sound suppressing gun barrel 100 having a breach end 106, a muzzle opening 108, and a muzzle wall 120 is configured substantially identically with sound suppressing gun barrel 1, with the exception that the arm portions of its circumferential array of "U" channels extend helically about bullet channel 109. Where rifling at the breachward end of such bullet channel 109 has a helical pitch, the helical pitch of channel forming walls (e.g., walls 162, 164, 172, and 184), and the channels formed by such walls (e.g., channels 182, 186, 174, 176, 156, and 158) preferably extend along a substantially matching helical pitch. Such matching of the helixes of the rifling and the channel forming walls advantageously assures that bullet spin at the muzzle end of the gun barrel matches the paths of the radially inner ends of the channel forming walls. The helical extensions of the "U" channels' arms also advantageously increase the effective lengths of such arms.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A sound suppressing gun barrel comprising:

(a) a bullet channel having breachward and muzzleward ends;

(b) at least a first "U" shaped channel positioned radially outwardly from the bullet channel, said channel having a web portion having circumferential and oppositely circumferential ends, said channel further having first and second gas conveying arm portions respectively extending muzzlewardly from the circumferential and oppositely circumferential ends of the web portion; and (c) an inlet port opening the at least first "U" shaped channel at a muzzleward end of the first gas conveying arm portion, the inlet port communicating with the bullet channel.

2. The sound suppressing gun barrel of claim 1 further comprising an outlet port further opening the at least first "U" shaped channel at a muzzleward end of said channel's second gas conveying arm portion.

3. The sound suppressing gun barrel of claim 2 further comprising a plurality of second "U" channels, each channel among the plurality of second "U" channels having a web portion, having first and second gas conveying arm portions, having an intake port, and having an outlet port, wherein the at least first and plurality of second "U" channels are circumferentially arrayed about the bullet channel.

4. A sound suppressing gun barrel comprising:

(a) a bullet channel having breachward and muzzleward ends;

(b) at least a first "U" shaped channel positioned radially outwardly from the bullet channel, said channel having a web portion having circumferential and oppositely circumferential ends, said channel further having first and second gas conveying arm portions respectively extending muzzlewardly from the circumferential and oppositely circumferential ends of the web portion;

(c) an inlet port opening the at least first "U" shaped channel at a muzzleward end of the first gas conveying arm portion, the inlet port communicating with the bullet channel;

(d) an outlet port further opening the at least first "U" shaped channel at a muzzleward end of said channel's second gas conveying arm portion; and (e) a plurality of second "U" channels, each channel among the plurality of second "U" channels having a web portion, having first and second gas conveying arm portions, having an intake port, and having an outlet port, wherein the at least first and plurality of second "U" channels are circumferentially arrayed about the bullet channel, wherein each channel among the at least first and plurality of second "U" channels has a radially outer end, and further comprising a circumferentially extending ceiling closing said channels at said radially outer ends.

5. The sound suppressing gun barrel of claim 4 wherein each outlet port is positioned at a muzzleward end of the ceiling.

6. The sound suppressing gun barrel of claim 5 further comprising a plurality of vanes, each vane being positioned operatively at one of the gas inlet ports for breachwardly deflecting gas entering said one of the ports.

7. The sound suppressing gun barrel of claim 6 wherein each vane has a concave breachward face.

8. The sound suppressing gun barrel of claim 7 wherein each inlet port is longitudinally oblongated, and wherein the vanes are arranged in series, each vane series extending along one of the longitudinally oblongated inlet ports.

9. The sound suppressing gun barrel of claim 7 wherein each "U" channel's web portion has a concave muzzleward face.

10. The sound suppressing gun barrel of claim 9 wherein each arm portion among the "U" channels' first and second gas conveying arm portions has a circumferential dimension, and wherein the circumferential dimensions of said channels' first gas conveying arm portions are greater than the circumferential dimensions of said channels' second gas conveying arm portions.

11. The sound suppressing gun barrel of claim 10 wherein each gas inlet port opens radially outwardly at the bullet channel's muzzleward end.

12. The sound suppressing gun barrel of claim 11 wherein each "U" channel's gas outlet port is positioned muzzlewardly from said each "U" channel's intake port.

13. The sound suppressing gun barrel of claim 12 wherein each arm portion among the "U" channels' first and second gas conveying arm portions extends helically about the bullet channel, and wherein said each arm portion has a helical pitch.

14. The sound suppressing gun barrel of claim 13 wherein the bullet channel's breachward end has rifling having a helical pitch.

15. The sound suppressing gun barrel of claim 14 wherein the helical pitches of the first and second gas conveying arm portions, and the rifling's helical pitch are substantially equal to each other.

16. The sound suppressing gun barrel of claim 12 further comprising a plurality of sound reflecting cavities, each sound reflecting cavity opening radially inwardly and being positioned muzzlewardly from one of the gas outlet ports.

17. The sound suppressing gun barrel of claim 16 wherein each sound reflecting cavity's radially inward opening communicates with the muzzleward end of the bullet channel.

18. The sound suppressing gun barrel of claim 17 wherein the bullet channel has a longitudinal axis, and wherein each sound reflecting cavity is bounded by circumferential and oppositely circumferential walls, said walls extending helically with respect to the longitudinal axis.

19. The sound suppressing gun barrel of claim 17 further comprising a multiplicity of sound reflection baffles, each sound reflection baffle longitudinally partitioning one of the sound reflecting cavities.

* * * * *